US011337890B2

(12) United States Patent
Kibele et al.

(10) Patent No.: US 11,337,890 B2
(45) Date of Patent: May 24, 2022

(54) PACKAGING ASSEMBLY AND CONTAINER FOR SAME, METHOD OF MAKING A PACKAGING ASSEMBLY, AND ASSOCIATED METHOD OF ACTIVATING AN ACTIVE AGENT

(71) Applicants: CSP TECHNOLOGIES, INC., Auburn, AL (US); CONSTANTIA FLEXIBLES GROUP GMBH, Vienna (AT)

(72) Inventors: Ralf Kibele, Bruckmuehl (DE); Wilhelm Zuser, Herzogenburg (AT); Roland Brunsteiner, Rohrendorf (AT); Thomas Schwarz, Gottmadingen (DE)

(73) Assignee: CSP Technologies, Inc., Auburn, AL (US)

( * ) Notice: Subject to any disclaimer, the term of this patent is extended or adjusted under 35 U.S.C. 154(b) by 0 days.

(21) Appl. No.: 16/649,080

(22) PCT Filed: Sep. 17, 2018

(86) PCT No.: PCT/US2018/051308

§ 371 (c)(1),
(2) Date: Mar. 19, 2020

(87) PCT Pub. No.: WO2019/060244

PCT Pub. Date: Mar. 28, 2019

(65) Prior Publication Data

US 2020/0268603 A1 Aug. 27, 2020

Related U.S. Application Data

(60) Provisional application No. 62/560,980, filed on Sep. 20, 2017.

(51) Int. Cl.
*B65B 7/28* (2006.01)
*A61J 1/03* (2006.01)
(Continued)

(52) U.S. Cl.
CPC ..... *A61J 1/035* (2013.01); *B65B 5/04* (2013.01); *B65B 7/28* (2013.01); *B65D 81/266* (2013.01)

(58) Field of Classification Search
CPC .. B65B 7/168; B65B 7/28; B65B 5/04; B65B 7/2878
(Continued)

(56) References Cited

U.S. PATENT DOCUMENTS 3,343,897 A * 9/1967 Walther ..... B65D 75/367 312/31
3,826,358 A * 7/1974 Butler ..... B65D 81/266 206/204
(Continued)

FOREIGN PATENT DOCUMENTS

DE 1544098 A1 1/1971
DE 202014103682 U1 12/2015

OTHER PUBLICATIONS

International Search Report for International Application No. PCT/US2018/051308, dated Nov. 21, 2018.

*Primary Examiner* — Gloria R Weeks
(74) *Attorney, Agent, or Firm* — Mark T Vogelbacker; Eckert Seamans Cherin & Mellott, LLC

(57) ABSTRACT

A container for a packaging assembly can include a body having a base and a sidewall extending therefrom. The body can define an interior including a product space configured for housing at least one product, and can have an opening leading to the interior. The container can include an active agent located within a compartment that is provided within the interior. The compartment can be sealed by a sealing layer to encapsulate the active agent within the compartment so as to prevent fluid communication between the active agent and the product space.

17 Claims, 5 Drawing Sheets

(51) Int. Cl.
*B65D 81/26* (2006.01)
*B65B 5/04* (2006.01)

(58) Field of Classification Search
USPC ..... 206/204
See application file for complete search history.

(56) References Cited

U.S. PATENT DOCUMENTS 4,861,632 A * 8/1989 Caggiano ..... B32B 7/02 428/35.2
5,114,003 A 5/1992 Jackisch et al.
5,911,937 A 6/1999 Hekal
6,080,350 A 6/2000 Hekal
6,124,006 A 9/2000 Hekal
6,130,263 A 10/2000 Hekal
6,174,952 B1 1/2001 Hekal et al.
6,194,079 B1 2/2001 Hekal
6,214,255 B1 4/2001 Hekal
6,221,446 B1 4/2001 Hekal
6,279,763 B1 8/2001 Bush
6,447,826 B1 * 9/2002 Matthews ..... A23B 4/16 426/126
6,486,231 B1 11/2002 Hekal
6,571,942 B2 * 6/2003 Riemenschneider ..... B65D 81/266 206/204
7,005,459 B2 2/2006 Hekal
8,919,546 B2 * 12/2014 Wada ..... B65D 81/26 206/204
10,828,234 B2 * 11/2020 Laemmle ..... B65B 41/12
2005/0178677 A1 * 8/2005 Morrow ..... B65D 51/28 206/219
2010/0043359 A1 * 2/2010 Skiffington ..... B65D 83/0011 53/471
2013/0157991 A1 * 6/2013 Aswania ..... A61P 43/00 514/171
2013/0220844 A1 * 8/2013 Logel ..... B65D 81/266 206/204
2015/0004287 A1 * 1/2015 Crump ..... B65D 81/268 426/118
2015/0136618 A1 * 5/2015 Patel ..... B65D 25/04 206/0.5
2016/0039955 A1 2/2016 Klein et al.
2016/0106150 A1 * 4/2016 Garcia ..... A24F 23/00 206/265

* cited by examiner

PACKAGING ASSEMBLY AND CONTAINER FOR SAME, METHOD OF MAKING A PACKAGING ASSEMBLY, AND ASSOCIATED METHOD OF ACTIVATING AN ACTIVE AGENT

CROSS-REFERENCE TO RELATED APPLICATIONS

This application is a U.S. National Phase of International Application No. PCT/US2018/051308, titled "PACKAGING ASSEMBLY AND CONTAINER FOR SAME, METHOD OF MAKING A PACKAGING ASSEMBLY, AND ASSOCIATED METHOD OF USING AND/OR ACTIVATING AN ACTIVE AGENT" and filed Sep. 17, 2018, which claims priority to U.S. Provisional Patent Application No. 62/560,980, titled "PACKAGING ASSEMBLY AND CONTAINER FOR SAME, METHOD OF MAKING A PACKAGING ASSEMBLY, AND ASSOCIATED METHOD OF ACTIVATING AN ACTIVE AGENT" and filed Sep. 20, 2017, all of which are herein incorporated by reference in their entirety.

FIELD

The disclosed concept relates to packaging assemblies such as, for example, packaging assemblies including moisture sensitive and/or oxygen sensitive products. The disclosed concept also relates to containers for packaging assemblies. The disclosed concept further relates to methods of making packaging assemblies. The disclosed concept also relates to methods of using and/or activating an active agent.

BACKGROUND

Moisture sensitive and/or oxygen sensitive products such as, for example, inhalers and tablets, are commonly contained in packaging assemblies. The packaging assemblies typically include a container which houses the product, and an active agent, such as a desiccant entrained polymer, desiccant sachet or desiccant canister. The active agent can function to, e.g., absorb moisture or scavenge oxygen that would otherwise compromise the integrity of the product. A known problem with packaging assemblies is that the active agent is typically in direct contact with the product. This arrangement can be problematic for a number of reasons. First, by locating the active agent in the same area of the container as the product, there is a potential that the active agent could be ingested by a user. For example, if the product constitutes a plurality of tablets, and the active agent is in the form of a desiccant containing sachet or cylindrical canister loosely sitting in the body of the container, a user could mistakenly grab/ingest the active agent instead of a tablet. Second, direct contact between the active agent and the product may result in fragments (e.g., dust particles) of the active agent breaking free and contaminating the product. In this situation, when the user uses the product, such as an inhaler, particles of the active agent could again be undesirably ingested by the user.

In addition, an active agent provided in a container can lose its efficacy (i.e., be "used up") once exposed to the ambient environment for a relatively short period of time. One industry solution for this is that the active agent can be disposed in a capped container that is hermetically sealed immediately after loading the active agent into it. This is typically done in the test strip industry, wherein flip-top moisture-tight test strip vials are formed with desiccant inside and then the cap is closed as part of the process. This substantially prevents the ingress of moisture into the vial, thus preserving the useful life of the desiccant. However, not all package configurations are amenable to such a solution. For example, where a foil or polymer container is provided, e.g., for packaging a medical device or drug delivery device, the container may not be practically capped and thus sealed until the time of packaging. In such a case, the desiccant in the container would be quickly "used up" unless other costly or inconvenient measures are taken (e.g., storing the containers in a special room with very low humidity, providing a removable moisture-tight cover or adding the desiccant at the time of packaging the product).

There is thus a need for an improved packaging assembly and container for the same. There is also a need for an improved method of making a packaging assembly, and for an improved method of using and/or activating an active agent.

BRIEF SUMMARY OF THE DISCLOSED CONCEPT

As one aspect of the disclosed concept, a container is provided for a packaging assembly. The container includes a body having a base and a sidewall extending upwardly therefrom, the body defining an interior including a product space configured for housing at least one product, the body further having an opening leading to the interior. The container further includes an active agent located within a compartment that is provided within the interior. The compartment is sealed by a sealing layer in order to encapsulate the active agent within the compartment so as to prevent fluid communication between the active agent and the product space.

As another aspect of the disclosed concept, a method of making a packaging assembly includes providing the aforementioned container; puncturing and/or removing at least a portion of the sealing layer so as to create fluid communication between the active agent and the product space; disposing within the product space of the container at least one moisture sensitive and/or oxygen sensitive product; and providing a cover that seals the opening to enclose the at least one product within the packaging assembly.

As another aspect of the disclosed concept, a method of activating an active agent includes providing the aforementioned container, and in an in-line process, puncturing and/or removing at least a portion of the sealing layer to establish fluid communication between the compartment and the product space.

As another aspect of the disclosed concept, a packaging assembly includes a moisture and/or oxygen sensitive product; a sealing layer; and a container including a body having a base and a sidewall extending therefrom. The body defines an interior having a product space for housing the moisture and/or oxygen sensitive product. The body further has an opening leading to the interior, wherein the sealing layer is sealed to the sidewall in order to encapsulate the moisture and/or oxygen sensitive product within the interior. An active agent is located within a compartment that is provided within the interior. The compartment is sealed by a container cover, the container cover optionally being a foil sealing layer, in order to separate the active agent from the moisture and/or oxygen sensitive product.

In another embodiment, the present disclosure is directed to a container having a body that includes a sealing layer therein. The sealing layer divides an interior of the body into two separate portions. The sealing layer being configured to support a product within a first one of the two separate portions of the interior of the body. The sealing layer also being configured to fluidly separate the product from an active agent within a second one of the two separate portions of the interior of the container.

In an optional embodiment, the packaging assembly is a blister pack comprising at least or a plurality of blisters, each blister providing a product space.

BRIEF DESCRIPTION OF THE DRAWINGS

The disclosed concept will be described in conjunction with the following drawings in which like reference numerals designate like elements and wherein.

DETAILED DESCRIPTION OF THE PREFERRED EMBODIMENTS

While systems, devices and methods are described herein by way of examples and embodiments, those skilled in the art recognize that the presently disclosed technology is not limited to the embodiments or drawings described. Rather, the presently disclosed technology covers all modifications, equivalents and alternatives falling within the spirit and scope of the appended claims. Features of any one embodiment disclosed herein can be omitted or incorporated into another embodiment.

Any headings used herein are for organizational purposes only and are not meant to limit the scope of the description or the claims. As used herein, the word "may" is used in a permissive sense (i.e., meaning having the potential to) rather than the mandatory sense (i.e., meaning must). Unless specifically set forth herein, the terms "a," "an" and "the" are not limited to one element but instead should be read as meaning "at least one." As used herein, the word "unitary" means a component is created as a single piece or unit. That is, a component that includes pieces that are created separately and then coupled together as a unit is not a "unitary" component or body. As employed herein, the statement that two or more parts or components "engage" one another shall mean that the parts exert a force against one another either directly or through one or more intermediate parts or components. As employed herein, the term "number" shall mean one or an integer greater than one (i.e., a plurality). The terminology includes the words noted above, derivatives thereof and words of similar import.

Figure 1:
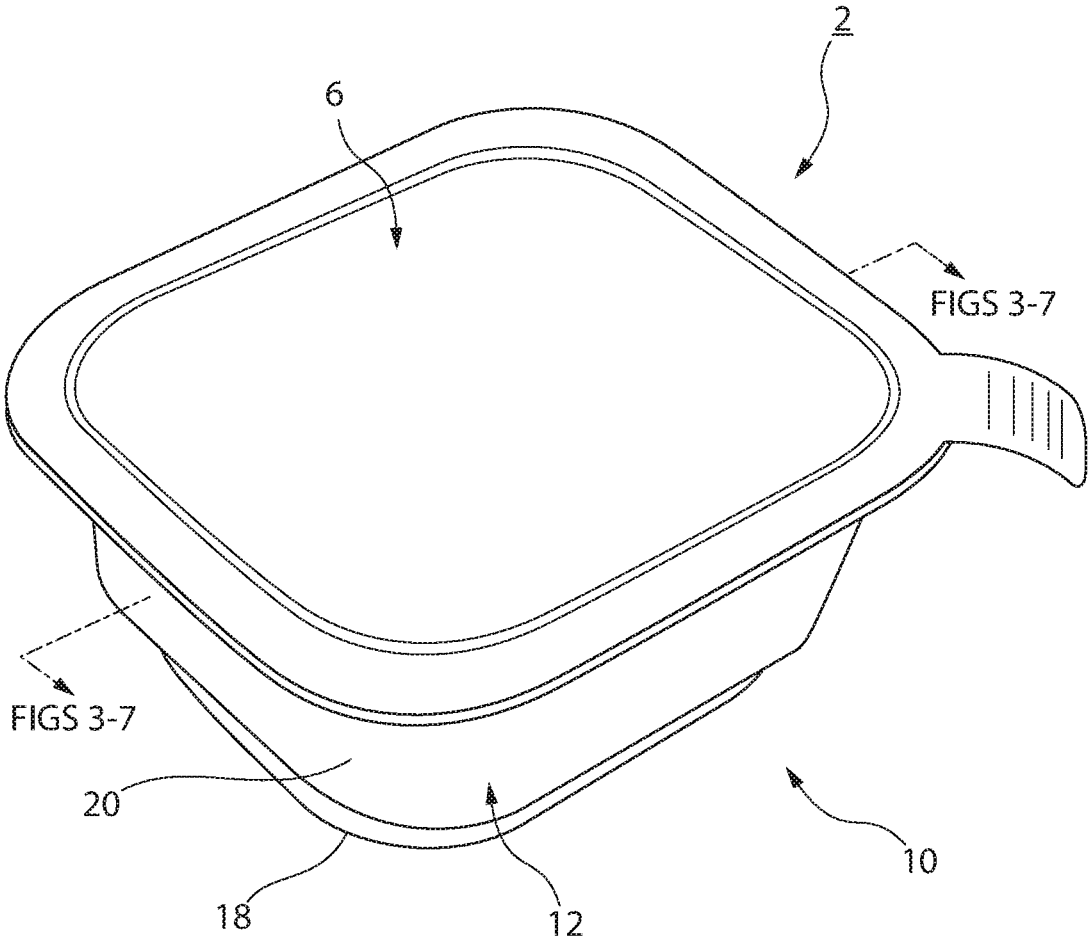
FIG. 1 is an isometric view of a packaging assembly and container for the same, in accordance with one non-limiting embodiment of the disclosed concept.
Figure 2:
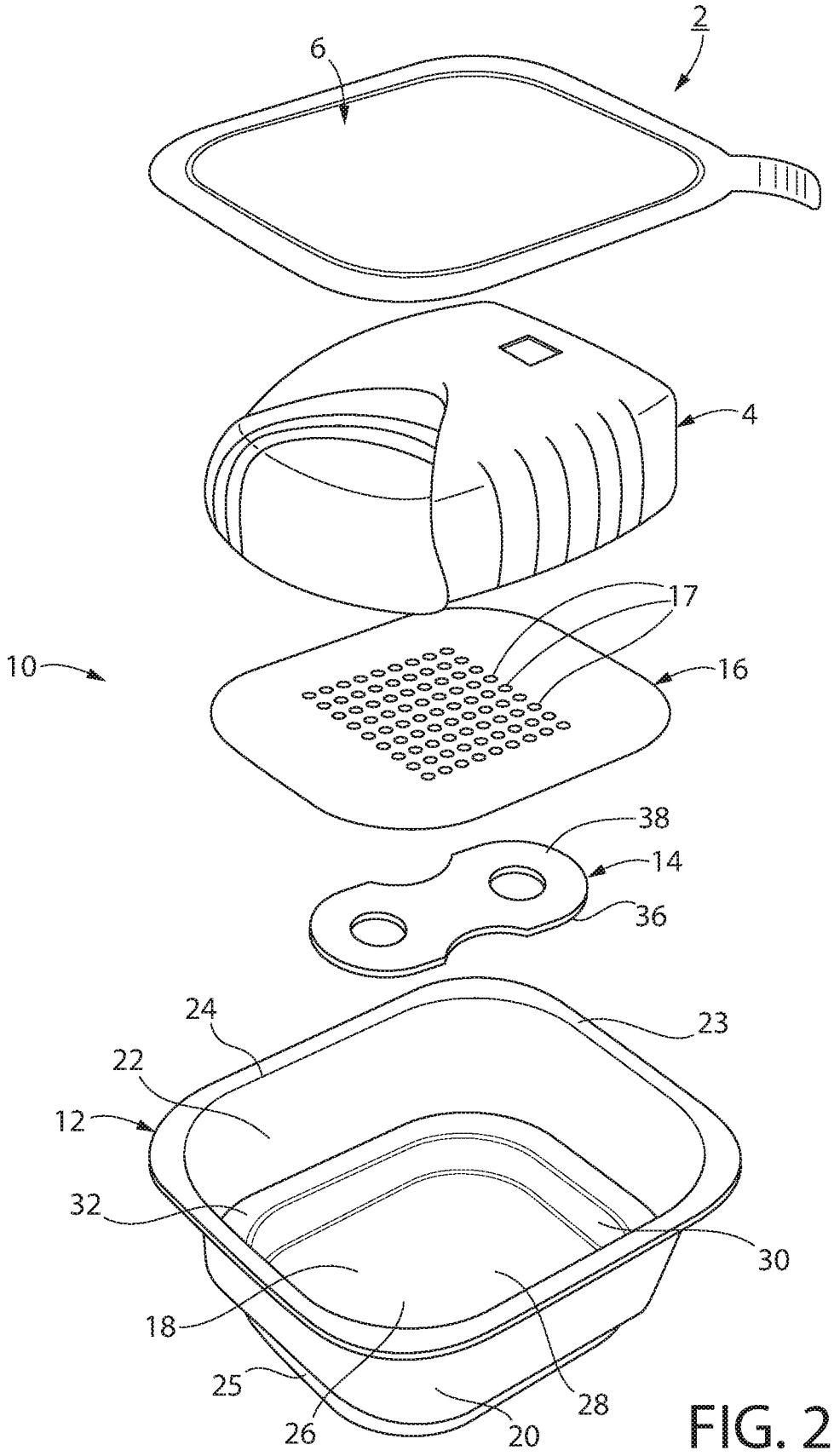
FIG. 2 is an exploded isometric view of the packaging assembly and container therefor of FIG. 1.

Referring now in detail to the various figures of the drawings wherein like reference numerals refer to like parts throughout, FIG. 1 and FIG. 2 are isometric and exploded isometric views, respectively, of a packaging assembly 2, in accordance with one non-limiting embodiment of the disclosed concept. Packaging assembly 2 is configured for transporting, storing, and/or housing a moisture and/or oxygen sensitive product, such as an example inhaler 4 (shown in FIG. 2) that is included with fully assembled packaging assembly 2. Packaging assembly 2 can also include a container cover 6 and a container 10.

Referring to FIG. 2, container 10 includes a body 12, an active agent or member 14, and a sealing layer 16. In one embodiment, the body 12 is a unitary component made from a single piece of material such as, for example and without limitation, aluminum. However, it is also contemplated herein that body can include multiple components separately joined together. In one exemplary embodiment, container cover 6 and sealing layer 16 both include foil layers that are spaced from and optionally oriented parallel to each other. It will, however, be appreciated that suitable alternative configurations are contemplated by the disclosed concept. As will be discussed in greater detail below, sealing layer 16 can be structured to provide a physical barrier and substantial gas barrier between inhaler 4 and active agent 14. In this manner, known problems with alternative packaging assemblies as discussed in the Background section above, such as accidental ingesting of active agents and/or undesirable contaminating of products by the active agents, are significantly minimized and/or eliminated.

Continuing to refer to FIG. 2, body 12 has a base 18 and a sidewall 20 extending upwardly therefrom. Further, body 12 defines an interior 22 that has a product space configured to receive inhaler 4 therein, and/or any suitable alternative moisture and/or oxygen sensitive product (e.g., without limitation, pharmaceutical products, diagnostic products, a medical device or a drug delivery device). Body 12 further has a first end 23 and a second end 25 located opposite and distal first end 23. First or top end 23 that surrounds an opening 24 leading to interior 22.

Optionally, when packaging assembly 2 is assembled, container cover 6 is sealed to sidewall 20 at first end 23 in order to encapsulate inhaler 4 within interior 22. In one embodiment, the seal between the container cover 6 and sidewall 20 at first end 23 is moisture tight and that the cover and container materials provide an effective gas barrier, which is substantially impermeable to moisture and/or oxygen. The container cover 6 can be sealed to the container body 12, e.g., via a mechanical interlock, an adhesive or a heat seal. Moisture tightness may be advantageous to at least partially prevent moisture from entering a container, which moisture could have a deleterious effect on the shelf life of the stored product.

The term "moisture tight" with respect to the package assembly 2 is defined herein as a container having a moisture ingress rate of less than 1500 micrograms per day, at 80% relative humidity and 22.2° C. Moisture ingress may thus fall within one of several ranges. One such range is between 25 and 1500 micrograms per day under the aforementioned ambient conditions. Another such range is 50-1000 micrograms per day under the aforementioned ambient conditions. A further such range is 100-1000 micrograms per day under the aforementioned ambient conditions. Still further optional ranges include 100-450 micrograms per day, optionally 150-400 micrograms per day, optionally 150-350 micrograms per day, optionally 150-300 micrograms per day.

In one exemplary embodiment, interior 22 has a compartment 26 optionally located proximate second or bottom end 25, and active agent 14 includes a desiccant or an oxygen scavenger located within compartment 26. In a preferred embodiment, active agent 14 is a desiccant entrained polymer that is a unitary component made of a single piece of material. Additionally, as disclosed herein, active agent 14 is optionally a generally planar member. An entrained polymer, whether entrained with desiccant or another active agent may include a base polymer (for structure), a desiccant (or other active agent) and optionally a channeling agent. These types of active entrained polymers and methods of making and using the same are disclosed, e.g., in Applicant's U.S. Pat. Nos. 5,911,937, 6,214,255, 6,130,263, 6,080,350, 6,174,952, 6,124,006 and 6,221,446, and U.S. Pat. Pub. No. 2016/0039955, all of which are incorporated by reference herein in their entireties. Optionally, the entrained polymer may be in the form of a film that is loose or optionally heat staked to a surface of the compartment 26.

Alternatively, the desiccant may include loose desiccant beads or a sachet containing the same. While the exemplary embodiments herein reflect active agent 14 being located within compartment 26 proximate second end 25 of body 12, it is contemplated that an active agent might be located on a sidewall of a body of a container and extending between opposing ends, rather than in a compartment proximate a base of the body of the container.

In the embodiment where each active member contains a desiccant, moisture absorption is desired. However, where moisture absorption is not desired, the active member can include alternative active agents. For example, in another embodiment, the active member contains a material selected from the group consisting of activated carbon, carbon black, ketcham black and diamond powder. In a further embodiment, an active agent including one or more layers of the active member contains a material such as absorption microspheres, $BaTiO_3$, $SrTiO_3$, $SiO_2$, $Al_2O_3$, ZnO, $TiO_2$, MnO, CuO, $Sb_2O_3$, silica, calcium oxide and ion exchange resins. In yet another embodiment, the absorbing agent containing layer of the active member 116 contains two or more types of absorbing agents. The suitable absorbing agent is chosen so as to achieve absorption of the desired vapor or gas for the desired end use (e.g. absorption of moisture, oxygen, carbon dioxide, nitrogen or other undesired gases or vapors).

The active member (whether desiccant, oxygen scavenger, a releasing material or ingredient, etc., or combination thereof) is capable of acting on, interacting or reacting with a selected material (e.g., moisture or oxygen). Examples of such actions or interactions may include absorption, adsorption (sorption, generally) or release of the selected material. Each active member can be extruded or molded, for example. Optionally, the active member can be formed in a desired shape or pattern (e.g., on a backing) via an in-line melt adhesion thermal bonding process.

The active member can include an "active ingredient" in a base material. The active ingredient(s) (i) can be immiscible with the base material (e.g., polymer) and when mixed and heated with the base polymer and a channeling agent, will not melt, i.e., has a melting point that is higher than the melting point for either the base polymer or the channeling agent, and/or (ii) acts on, interacts or reacts with a selected material. The term "active ingredient" may include but is not limited to materials that absorb, adsorb or release the selected material(s). Active ingredients according to the presently disclosed technology may be in the form of particles such as minerals (e.g., molecular sieve or silica gel, in the case of desiccants), but the presently disclosed technology should not be viewed as limited only to particulate active agents. For example, in some embodiments, an oxygen scavenging formulation may be made from a resin which acts as, or as a component of, the active agent.

As used herein, the term "base material" is a component (preferably a polymer) of an entrained active material, other than the active agent, that provides structure for the entrained material.

As used herein, the term "base polymer" is a polymer optionally having a gas transmission rate of a selected material that is substantially lower than, lower than or substantially equivalent to, that of the channeling agent. By way of example, such a transmission rate would be a water vapor transmission rate in embodiments where the selected material is moisture and the active ingredient is a water absorbing desiccant. The primary function of the base polymer is to provide structure for the entrained polymer. Suitable base polymers may include thermoplastic polymers, e.g., polyolefins such as polypropylene and polyethylene, polyisoprene, polybutadiene, polybutene, polysiloxane, polycarbonates, polyamides, ethylene-vinyl acetate copolymers, ethylene-methacrylate copolymer, poly(vinyl chloride), polystyrene, polyesters, polyanhydrides, polyacrylianitrile, polysulfones, polyacrylic ester, acrylic, polyurethane and polyacetal, or copolymers or mixtures thereof.

Referring to such a comparison of the base polymer and channeling agent water vapor transmission rate, in one embodiment, the channeling agent has a water vapor transmission rate of at least two times that of the base polymer. In another embodiment, the channeling agent has a water vapor transmission rate of at least five times that of the base polymer. In another embodiment, the channeling agent has a water vapor transmission rate of at least ten times that of the base polymer. In still another embodiment, the channeling agent has a water vapor transmission rate of at least twenty times that of the base polymer. In still another embodiment, the channeling agent has a water vapor transmission rate of at least fifty times that of the base polymer. In still another embodiment, the channeling agent has a water vapor transmission rate of at least one hundred times that of the base polymer.

As used herein, the term "channeling agent" or "channeling agents" is defined as a material that is immiscible with the base polymer and has an affinity to transport a gas phase substance at a faster rate than the base polymer. Optionally, a channeling agent is capable of forming channels through the entrained polymer when formed by mixing the channeling agent with the base polymer. Optionally, such channels are capable of transmitting a selected material through the entrained polymer at a faster rate than in solely the base polymer.

As used herein, the term "channels" or "interconnecting channels" is defined as passages formed of the channeling agent that penetrate through the base polymer and may be interconnected with each other.

As used herein, the term "entrained polymer" is defined as a monolithic material formed of at least a base polymer with an active agent and optionally also a channeling agent entrained or distributed throughout. An entrained polymer thus includes two-phase polymers and three phase polymers. A "mineral loaded polymer" is a type of entrained polymer, wherein the active agent is in the form of minerals, e.g., mineral particles such as molecular sieve or silica gel. The term "entrained material" is used herein to connote a monolithic material comprising an active agent entrained in a base material wherein the base material may or may not be polymeric.

As used herein, the term "monolithic," "monolithic structure" or "monolithic composition" is defined as a composition or material that does not consist of two or more discrete macroscopic layers or portions. Accordingly, a "monolithic composition" does not include a multi-layer composite.

As used herein, the term "phase" is defined as a portion or component of a monolithic structure or composition that is uniformly distributed throughout, to give the structure or composition it's monolithic characteristics.

As used herein, the term "selected material" is defined as a material that is acted upon, by, or interacts or reacts with an active agent and is capable of being transmitted through the channels of an entrained polymer. For example, in embodiments in which a desiccant is used as an active agent, the selected material may be moisture or a gas that can be absorbed by the desiccant. In embodiments in which a releasing material is used as an active agent, the selected material may be an agent released by the releasing material, such as moisture, fragrance, or an antimicrobial agent (e.g., chlorine dioxide). In embodiments in which an adsorbing material is used as an active ingredient, the selected material may be certain volatile organic compounds and the adsorbing material may be activated carbon.

As used herein, the term "three phase" is defined as a monolithic composition or structure including three or more phases. An example of a three phase composition according to the presently disclosed technology would be an entrained polymer formed of a base polymer, active agent, and channeling agent. Optionally, a three phase composition or structure may include an additional phase, e.g., a colorant.

Entrained polymers may be two phase formulations (i.e., comprising a base polymer and active ingredient, without a channeling agent) or three phase formulations (i.e., comprising a base polymer, active agent and channeling agent). Entrained polymers are described, for example, in U.S. Pat. Nos. 5,911,937, 6,080,350, 6,124,006, 6,130,263, 6,194,079, 6,214,255, 6,486,231, 7,005,459, and U.S. Pat. Pub. No. 2016/0039955, each of which is hereby incorporated by reference in its entirety.

An entrained material or polymer includes a base material (e.g., polymer) for providing structure, optionally a channeling agent and an active agent. The channeling agent forms microscopic interconnecting channels through the entrained polymer. At least some of the active ingredient is contained within these channels, such that the channels communicate between the active ingredient and the exterior of the entrained polymer via microscopic channel openings formed at outer surfaces of the entrained polymer. The active ingredient can be, for example, any one of a variety of absorbing, adsorbing or releasing materials, as described in further detail below. While a channeling ingredient is preferred, the presently disclosed technology broadly includes entrained materials that optionally do not include channeling agents, e.g., two phase polymers.

In any embodiment, suitable channeling agents may include a polyglycol such as polyethylene glycol (PEG), ethylene-vinyl alcohol (EVOH), polyvinyl alcohol (PVOH), glycerin polyamine, polyurethane and polycarboxylic acid including polyacrylic acid or polymethacrylic acid. Alternatively, the channeling agent can be, for example, a water insoluble polymer, such as a propylene oxide polymerisate-monobutyl ether, such as Polyglykol B01/240, produced by CLARIANT. In other embodiments, the channeling agent could be a propylene oxide polymerisate monobutyl ether, such as Polyglykol B01/20, produced by CLARIANT, propylene oxide polymerisate, such as Polyglykol D01/240, produced by CLARIANT, ethylene vinyl acetate, nylon 6, nylon 66, or any combination of the foregoing.

Suitable active ingredients according to the presently disclosed technology include absorbing materials, such as desiccating compounds. If the active agent is a desiccant, any suitable desiccant for a given application may be used. Typically, physical absorption desiccants are preferred for many applications. These may include molecular sieves, silica gels, clays and starches. Alternatively, the desiccant may be a chemical compound that forms crystals containing water or compounds which react with water to form new compounds.

Optionally, in any embodiment, the active agent may be an oxygen scavenger, e.g., an oxygen scavenging resin formulation.

Figure 3:
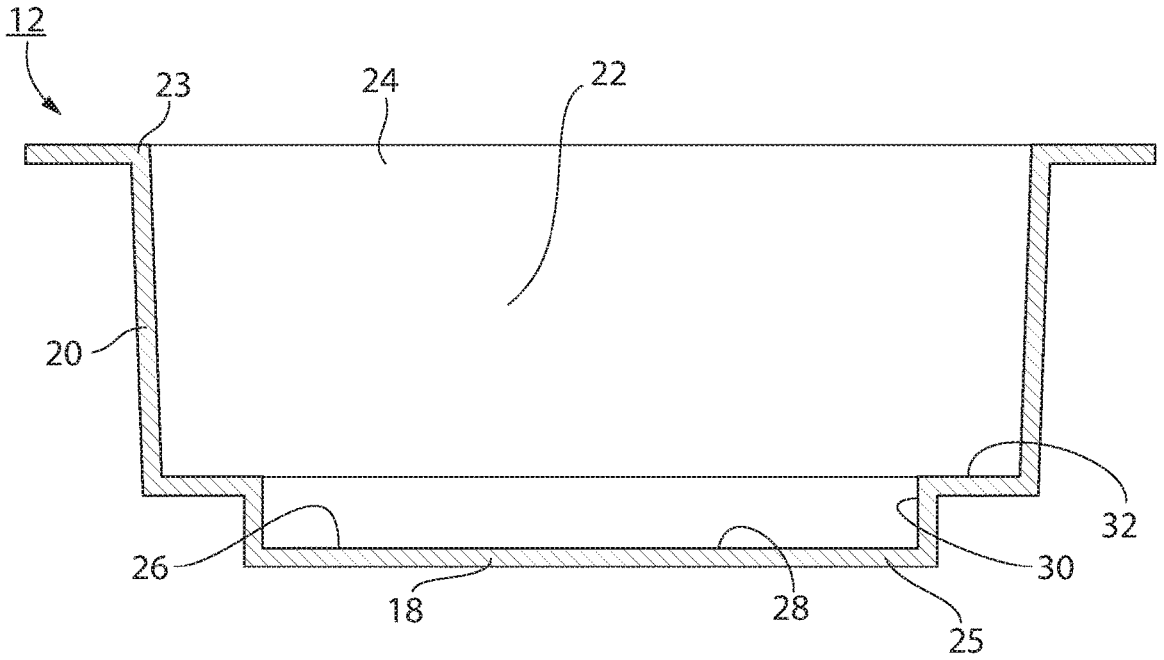
FIG. 3 is a section view of a body for the container of FIGS. 1 and 2.

In one embodiment, in order to separate active agent 14 from inhaler 4 so as to prevent active agent 14 from contaminating inhaler 4 (e.g., through particulate dusting), compartment 26 is sealed by sealing layer 16 before active agent is activated. More specifically, as shown in FIG. 3, compartment 26 includes a base surface 28, a first peripheral surface 30 extending upwardly from and being located outboard of base surface 28, and a second peripheral surface 32 extending laterally outwardly from (and optionally perpendicular to) the first peripheral surface 30 and being spaced from base surface 28.

Figure 4:
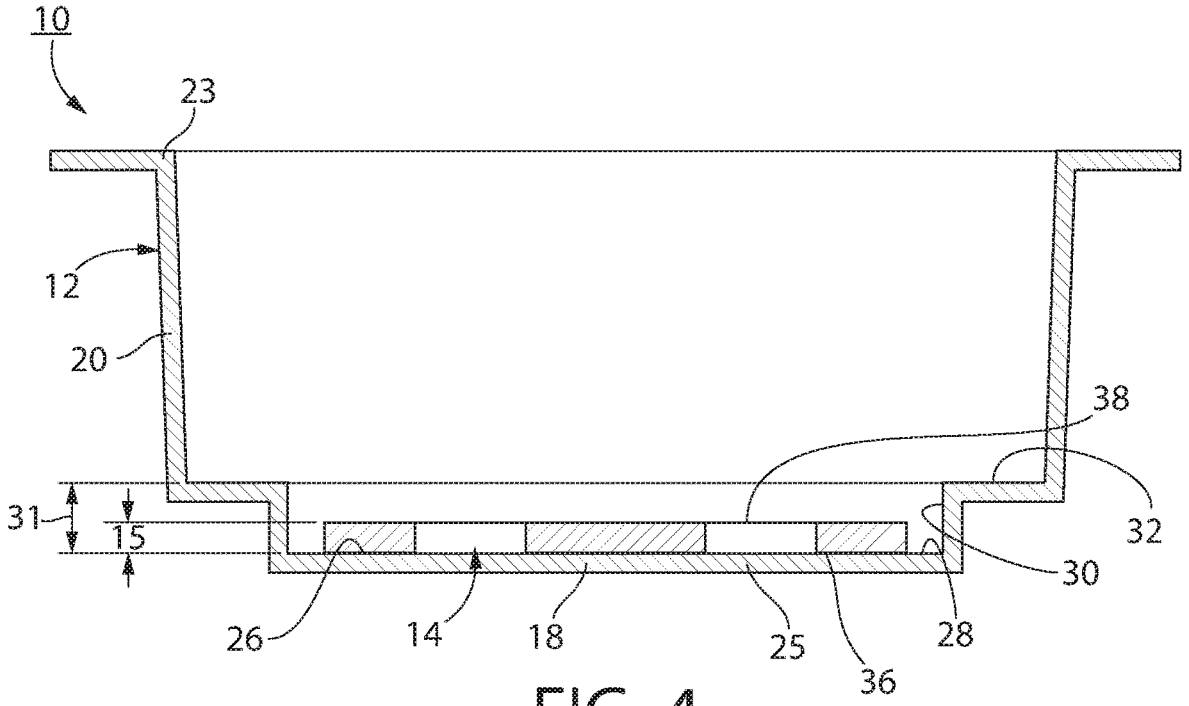
FIG. 4 is a section view of the container of FIGS. 1 and 2, shown without a sealing layer.

As shown in FIG. 4, active agent 14 has a first surface 36 and a second surface 38 parallel to and facing away from first surface 36. Optionally, first surface 36 faces and is located on base surface 28 of compartment 26. In one embodiment, first surface 36 of active agent 14 is heat sealed to base surface 28 or somehow adhered thereto. First surface 36 may be adhered to base surface 28 by other suitable mechanisms, without departing from the scope of the disclosed concept. As such, the likelihood of active agent 14 becoming detached from compartment 26 is significantly minimized. Additionally, in one example embodiment, base surface 28 is optionally oriented parallel to second peripheral surface 32, and is perpendicular to first peripheral surface 30.

Continuing to refer to FIG. 4, first peripheral surface 30 has a height 31, and active agent 14 has a thickness 15 extending between surfaces 36, 38 that is less than height 31. In one example embodiment, thickness 15 is from 0.15 mm to 5.0 mm. In another example embodiment, thickness 15 is less than 2.0 mm. In this manner, and for reasons that will be more apparent below, active agent 14 is spaced from inhaler 4 (FIGS. 2 and 7) when packaging assembly 2 is assembled.

Figure 5:
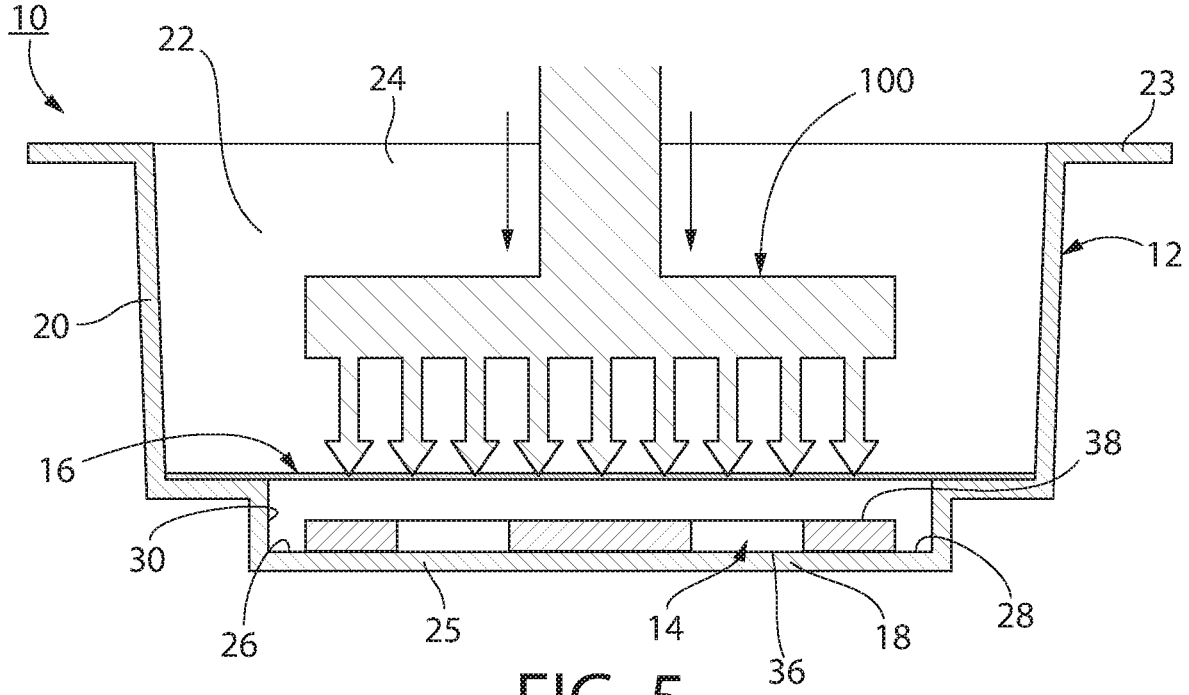
FIG. 5 is a section view of the container of FIG. 4, shown with a sealing layer and a tool, before the tool has punctured the sealing layer.

Referring to FIG. 5, in one embodiment, sealing layer 16 is sealed to second peripheral surface 32 in order to encapsulate active agent 14 within compartment 26 (e.g., so as to prevent fluid communication between active agent 14 and the product space which contains inhaler 4 (FIG. 2)). That is, before sealing layer 16 is pierced, sealing layer 16 encapsulates active agent 14 within compartment 26 in order to preserve active agent 14. In this way, the active agent 14 is not prematurely exposed to moisture and/or oxygen present in the ambient environment and/or product space of the container.

Figure 6:
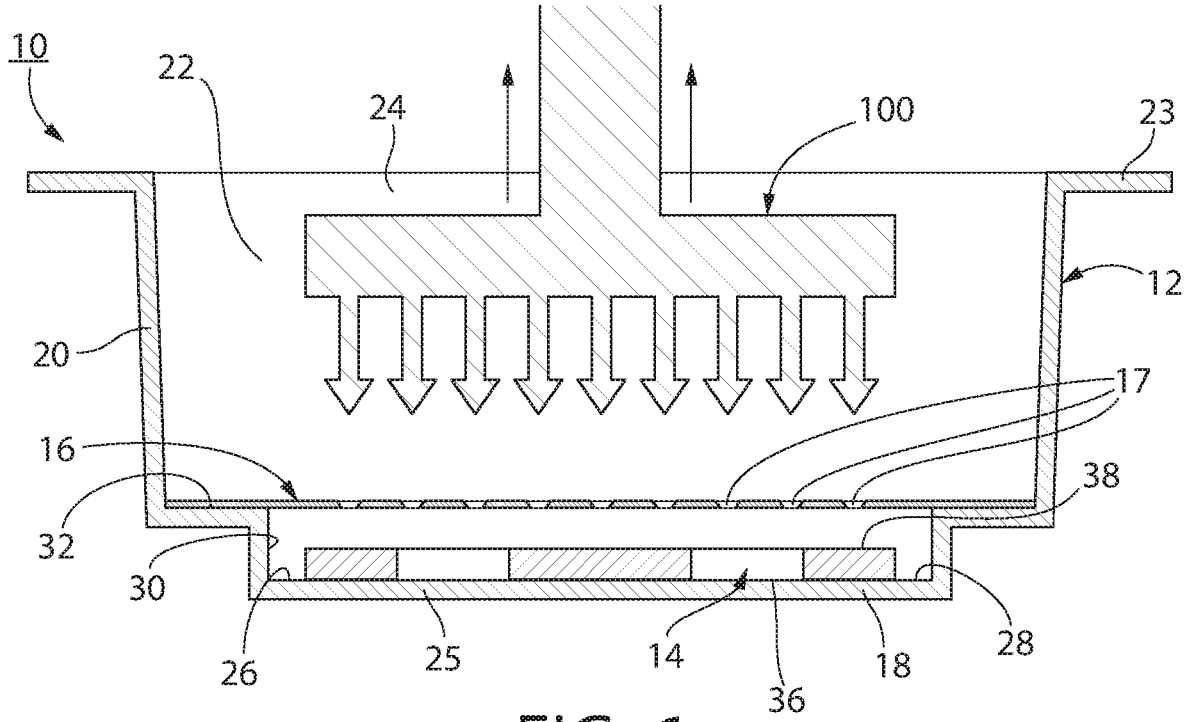
FIG. 6 is a section view of the container of FIG. 5, shown after the tool has punctured the sealing layer.

In one exemplary embodiment, sealing layer 16 is spaced from first end 23, and is optionally oriented parallel to surfaces 36, 38 of active agent 14. Optionally, the sealing layer 16 is located closer to the active agent 13 than the first end 23. The active agent 14 can be considered "activated" once it is exposed to environmental conditions that induce the active agent to perform its intended function. For example, an active agent 14 in the form of a desiccant or oxygen scavenger is "activated" once it is exposed to moisture and/or oxygen that is present in the ambient environment and/or product space of the container 10, which causes the active agent to absorb moisture or scavenge oxygen, as the case may be. Accordingly, in order to "activate" active agent 14, a fluid pathway can be provided and/or created between active agent 14 and the product space in which inhaler 4 is housed. To do so, a manufacturer can optionally employ a puncturing tool 100 to pierce or otherwise open sealing layer 16, thus creating at least one or a plurality of spaced-apart thru holes 17 in sealing layer 16, as shown in FIG. 6. In this manner, waste is significantly minimized by manufacturers who employ container 10 for packaging assemblies instead of prior art containers. For example, if a manufacturer or product filler has 1,000 containers and desires to use only 500 packaging assemblies in a filling process, the manufacturer only has to pierce sealing layers in 500 of the containers. This would leave the sealing layers in the other 500 containers un-pierced, allowing these remaining containers to be used later. Accordingly, the active agents in the 500 un-pierced containers will remain un-activated, and thus be not wasted. Prior art manufacturing and filling would typically expose all 1,000 active agents to ambient conditions, thus rendering them prematurely activated, resulting in a situation wherein the unused active agents would be compromised and/or wasted. Of course, the fluid pathway can be created in ways other than by employing the puncturing tool 100. For example, the sealing layer 16 could be peeled away or otherwise removed from the container 10 and the active agent 14 can be adhered or otherwise fixed to the interior bottom of the container 10.

Figure 7:
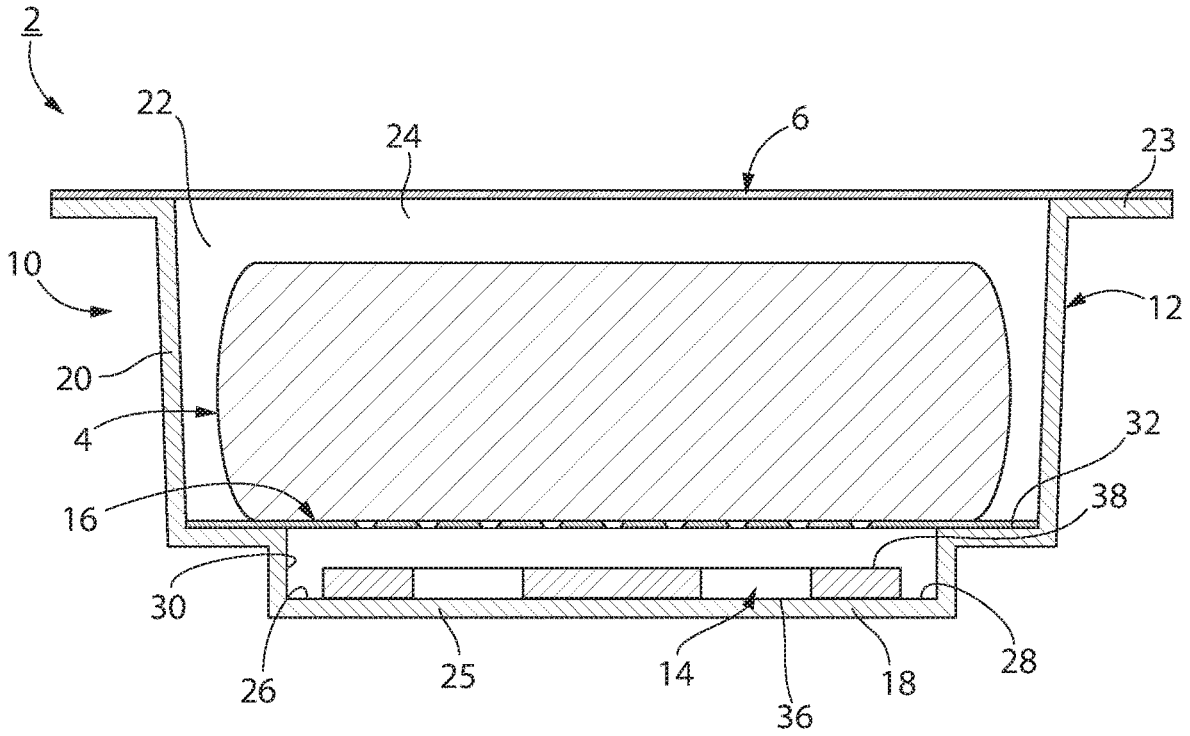
FIG. 7 is a section view of the packaging assembly of FIG. 1, after an active agent disposed below the sealing layer has been activated.

It follows that once sealing layer 16 is pierced to have one or a plurality of thru holes 17 or is peeled away, for example, inhaler 4 (FIG. 2) can be inserted into interior 22, thus allowing active agent 14 to be in fluid communication with inhaler 4 and absorb moisture and/or oxygen that would otherwise compromise the shelf life of inhaler 4. Finally, container cover 6 can be sealed to sidewall 20 at first end 23 in order to encapsulate inhaler 4 within interior 22, as shown in FIG. 7.

Accordingly, packaging assembly 2 and container 10 therefor provide a mechanism to allow active agent 14 to absorb moisture and/or oxygen within interior 22, and be physically separated from inhaler 4. For example, as shown in FIG. 7, sealing layer 16 functions to separate inhaler 4 from active agent 14. In other words, in this optional embodiment, active agent 14 does not engage (e.g., is spaced-apart from) inhaler 4. In this embodiment, sealing layer 16 provides a false bottom for container 10. Furthermore, sealing layer 16 functions as a physical barrier that isolates active agent 14 to compartment 26, such that the possibility of a user somehow grasping active agent 14 is significantly minimized and/or eliminated. Thus, known problems with packaging assemblies, such as accidental ingesting of active agents and/or contamination of products by active agents, are significantly minimized and/or eliminated in packaging assembly 2.

It will thus be appreciated that a method of making packaging assembly 2 includes providing container 10, puncturing and/or removing at least a portion of sealing layer 16 so as to create fluid communication between active agent 14 and the product space, disposing within the product space of container 10 at least one moisture sensitive and/or oxygen sensitive product 4, and providing a cover (e.g., without limitation, container cover 6) that seals opening 24 to enclose product 4 within packaging assembly 2. Furthermore, the providing a cover step may include sealing a container cover 6 to end 23 of sidewall 20. It will also be appreciated that a method of activating an active agent 14 includes providing container 10, and in an in-line process, puncturing and/or removing at least a portion of sealing layer 16 to establish fluid communication between compartment 26 and the product space.

Accordingly, it will be appreciated that the disclosed concept provides for an improved (e.g., without limitation, less wasteful, better protected against product contamination, and/or better protected against inadvertent active agent ingestion) packaging assembly 2 and container 10 for the same, method of making packaging assembly 2, and associated method of activating active agent 14, in which active agent 14 is able to absorb moisture and/or oxygen that would otherwise compromise the integrity of a product (e.g., without limitation, inhaler 4), and be physically separated (e.g., spaced-apart) from that product.

Optionally, the packaging assembly may be in the form of a blister package or blister pack, such as that disclosed in U.S. Pat. No. 6,279,763, which is incorporated herein by reference in its entirety. Blister packaging is commonly used to package oral solid dose medications, vitamins, probiotics, pills, tablets, capsules and the like. A blister pack typically includes a thermoformed polymer material, which includes a plurality of blisters, optionally in an array. The blisters are adhered to a backing, typically a foil backing that is pierceable or removable, which allows a user to access product housed within the blister. With such a configuration, according to an optional embodiment of the disclosed concept, each blister would constitute a container such as is described herein.

The present disclosed concept has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the disclosed concept that others can, by applying knowledge within the skill of the art, readily modify and/or adapt for various applications such specific embodiments, without undue experimentation, without departing from the general concept of the present disclosed concept. Therefore, such adaptations and modifications are intended to be within the meaning and range of equivalents of the disclosed embodiments, based on the teaching and guidance presented herein, it is to be understood that the phraseology or terminology herein is for the purpose of description and not of limitation, such that the terminology or phraseology of the present specification is to be interpreted by the skilled artisan in light of the teachings and guidance.

The breadth and scope of the present disclosed concept should not be limited by any of the above-described exemplary embodiments, but should be defined only in accordance with the following claims and their equivalents.

What is claimed is:

1. A method of assembling and filling a package, the method comprising:

providing a body having a base surface and a sidewall extending upwardly therefrom, the body defining an interior comprising a product space configured for housing at least one product, the body further having an opening leading to the interior;

heat sealing a unitary active agent to the base surface of a compartment within the interior of the body, the compartment comprising the base surface, a first peripheral surface extending upwardly from the base surface and laterally inward from the sidewall, and a second peripheral surface extending laterally outwardly from the first peripheral surface and connecting the first peripheral surface to the sidewall around the interior of the compartment, the base surface being spaced-apart below the second peripheral surface, the compartment being separate from the product space, the unitary active agent comprising at least one of a desiccant entrained polymer or an oxygen scavenger, inserting a sealing layer into the body and attaching at least a portion of the sealing layer to the body so that the sealing layer is configured to serve as a product supporting surface, at least a portion of the sealing layer being sealed to the second peripheral surface, the sealing layer being configured to separate the product space from the compartment and prevent fluid communication between the active agent and the product space;

puncturing or removing at least a portion of the sealing layer to permit fluid communication between the product space and the compartment; and inserting the at least one product into the product space and depositing the at least one product onto the sealing layer, the sealing layer separating the unitary active agent from the at least one product.

2. The method according to claim 1, further comprising: providing a cover that seals the opening of the body to enclose the at least one product within the body.

3. The method according to claim 2, wherein the cover is foil.

4. The method according to claim 1, wherein the base surface is disposed parallel to the second peripheral surface and perpendicular to the first peripheral surface.

5. The method according to claim 1, wherein the unitary active agent has a first surface and a second surface parallel to and facing away from the first surface, and wherein the first surface of the active agent faces the base surface.

6. The method according to claim 5, wherein the unitary active agent has a thickness measured from the first surface to the second surface of the active agent, and wherein the thickness is from 0.15 mm to 5.0 mm.

7. The method according to claim 5, wherein the sealing layer extends parallel to the first and second surfaces of the unitary active agent.

8. The method according to claim 1, wherein the body has a first end and a second end disposed opposite and distal the first end, and wherein the first end defines the opening leading to the interior, and wherein the sealing layer is spaced-apart from both the first and second ends.

9. The method according to claim 8, wherein the compartment is disposed proximate the second end.

10. The method according to claim 1, wherein the sealing layer is a foil sealing layer.

11. The method according to claim 1, wherein the step of puncturing or removing at least a portion of the sealing layer results in the sealing layer having a plurality of through holes to provide a fluid pathway between the unitary active agent and the product.

12. The method according to claim 1, wherein the product is moisture or oxygen sensitive and the active agent comprises a moisture absorber or oxygen scavenger.

13. The method according to claim 1, wherein the package is in the form of a blister pack comprising a plurality of blisters, wherein each blister houses a single product that is optionally an oral solid dose form.

14. A method of assembling and filling a package, the method comprising:

providing a body defining an interior comprising a product space configured for housing at least one product, the body further having an opening leading to the interior;

heat sealing a unitary active agent to a base surface of a compartment within the interior of the body, the compartment comprising the base surface, a first peripheral surface extending upwardly from the base surface and laterally inward from the sidewall, and a second peripheral surface extending laterally outwardly from the first peripheral surface and connecting the first peripheral surface to the sidewall, the base surface being spaced-apart below the second peripheral surface, the unitary active agent comprising a desiccant entrained polymer, attaching at least a portion of a sealing layer to the interior of the body so that the sealing layer is configured to serve as a product supporting surface, at least a portion of the sealing layer being sealed to the second peripheral surface, the sealing layer being configured to separate the product space from the compartment and prevent fluid communication between the active agent and the product space;

puncturing at least a portion of the sealing layer to permit fluid communication between the product space and the compartment;

inserting the at least one product into the product space and depositing the at least one product onto the sealing layer, the sealing layer separating the unitary active agent from the at least one product; and providing a cover that seals the opening of the body to enclose the at least one product within the body.

15. The method according to claim 14, wherein the unitary active agent has a thickness from 0.15 mm to 5.0 mm.

16. The method according to claim 15, wherein the sealing layer is a foil sealing layer.

17. The method according to claim 15, wherein the step of puncturing or removing at least a portion of the sealing layer results in the sealing layer having a plurality of through holes to provide a fluid pathway between the unitary active agent and the product.

* * * * *